US005125170A

United States Patent [19]

Krimsky et al.

[11] Patent Number: 5,125,170

[45] Date of Patent: Jun. 30, 1992

[54] FLOTATION DRYER NOZZLE

[75] Inventors: Leonard C. Krimsky, Englewood; Richard A. McCarthy; William P. Rounds, both of Ramsey, all of N.J.

[73] Assignee: Worldwide Converting Machinery, Allendale, N.J.

[21] Appl. No.: 508,098

[22] Filed: Apr. 11, 1990

[51] Int. Cl.[5] ..... F26B 13/00

[52] U.S. Cl. ..... 34/156; 34/155; 226/97

[58] Field of Search ..... 34/155, 156, 160; 226/7, 97

[56] References Cited

U.S. PATENT DOCUMENTS 3,448,907 12/1966 Otepka et al. ..... 34/156
4,058,244 11/1977 Vits ..... 34/156
4,274,210 6/1981 Stengard ..... 34/156
4,292,745 10/1981 Caratsch ..... 34/156
4,384,666 5/1983 Koponen et al. ..... 34/156
4,414,757 11/1983 Whipple ..... 34/156
4,501,553 2/1985 Imose et al. ..... 34/156
4,606,137 8/1986 Whipple ..... 34/156
4,787,547 11/1988 Hella et al. ..... 34/156
4,854,052 8/1989 Korpela ..... 34/156

*Primary Examiner*—Henry A. Bennet
*Assistant Examiner*—Denise L. F. Gromada
*Attorney, Agent, or Firm*—Shenier & O'Connor

[57] ABSTRACT

A flotation dryer nozzle in which respective outer narrow nozzle openings are formed at the edges of the side of the nozzle facing the web to be dried and respective wider nozzle openings are formed in the nozzle side facing the web inwardly of the narrow nozzle openings and in which respective pressure reduction regions are formed between the inside of the nozzle body and the wider nozzle openings.

7 Claims, 2 Drawing Sheets

FLOTATION DRYER NOZZLE

FIELD OF THE INVENTION

The invention relates to an improved flotation dryer nozzle and more specifically to a flotation dryer nozzle for use with very light gauge webs or films and with webs such as those having heavy adhesive coatings which require gentle drying.

BACKGROUND OF THE INVENTION

There are known in the prior art flotation dryers comprising a plurality of nozzles so arranged as floatingly to support the web being dried in a sine wave configuration. Such nozzles typically require discharge velocities in the order of 4,000 ft. per minute to provide a sufficient cushion to maintain good flotation of the web in a sine wave configuration.

While flotation dryers of the type known in the prior art are generally satisfactory for most webs, the velocities employed therein may cause flutter of very light gauge films or webs, thus creating the possibility of damage to the web or improper drying thereof. In addition, where heavy adhesive coatings, for example, are involved, velocities in flotation dryers of the prior art can cause problems by premature drying of the surface of the coating, thus inhibiting evaporation of solvents from within the coating, resulting in blistering and bubbling and the like.

In an attempt to solve the problem outlined above, there has been developed a flotation dryer nozzle in which a pair of outer slots form nozzles for directing streams of air at an angle toward each other to form a triangle when the nozzle is viewed in section. A perforated plate disposed between the slots permits air to flow from within the nozzle to the interior of the triangle so that the web is supported on the triangle. If the web is heavy, it sinks down into the triangle and starts penetrating the top thereof so that there is now a broader area of support for the web. At some stable equilibrium point the web will float, depending on tension and on the weight of the web. The problem with this proposed solution is that the velocity of air inside the triangle is such that it provides a scrubbing action which may cause overdrying or ripples in the web.

As an alternative to the arrangement in which auxiliary air was permitted to flow outwardly through perforations in a plate disposed between the nozzles, it has been suggested that air be permitted to flow inwardly through the perforations in such a plate and be exhausted to the atmosphere. We have discovered that this does not provide a solution to the problem since no appreciable inflow of air results.

SUMMARY OF THE INVENTION

One object of our invention is to provide an improved flotation dryer nozzle which overcomes the difficulties of flotation dryer nozzles of the prior art.

Another object of our invention is to provide an improved flotation dryer nozzle which is especially adapted for use with very light gauge films or webs.

Still another object of our invention is to provide an improved flotation dryer nozzle which is especially adapted for use with webs such as those carrying heavy adhesive coating which require gentle drying.

A still further object of our invention is to provide an improved flotation dryer nozzle which is simple in construction and in operation for the results achieved thereby.

Other and further objects of our invention will appear from the following description.

BRIEF DESCRIPTION OF THE DRAWINGS

In the accompanying drawings to which reference is made in the instant specification and which are to be read in conjunction therewith, and in which like reference characters are use to indicate like parts in the various views.

DESCRIPTION OF THE PREFERRED EMBODIMENT

Figure 1:
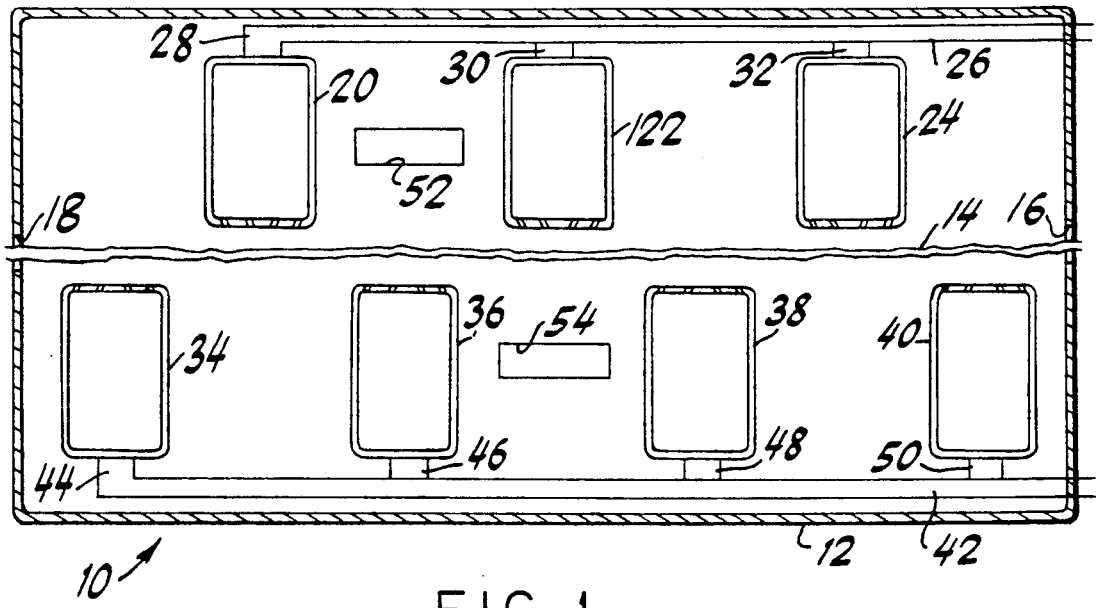
FIG. 1 is a partially diagrammatic view in section of a dryer incorporating our improved flotation dryer nozzle.

Referring now to FIG. 1 of the drawing, a dryer indicated generally by the reference character 10 which may incorporate our improved flotation dryer nozzle, includes a housing 12 for receiving a web 14 which passes through an entry 16 and out of an exit 18. Housing 12 contains a plurality of improved upper dryer nozzles 20, 22 and 24 adapted to be supplied with a heated drying medium, such as air, through a supply manifold 26 and respective branches 28, 30 and 32.

The dryer 10 includes a plurality of lower improved dryer nozzles 34, 36, 38 and 40 arranged in staggered relationship to the nozzles 20, 22 and 24 with the latter nozzles directing drying air downwardly onto the top of the web and former nozzles directing drying air upwardly onto the bottom of the web. A second supply manifold 42, which may lead from the same main supply as does manifold 26, has branches 44, 46, 48 and 50 which feed the respective nozzles 34, 36, 38 and 40. Exhaust ports 52 and 54 permit the escape of moisture laden air from the housing 12.

Figure 4:
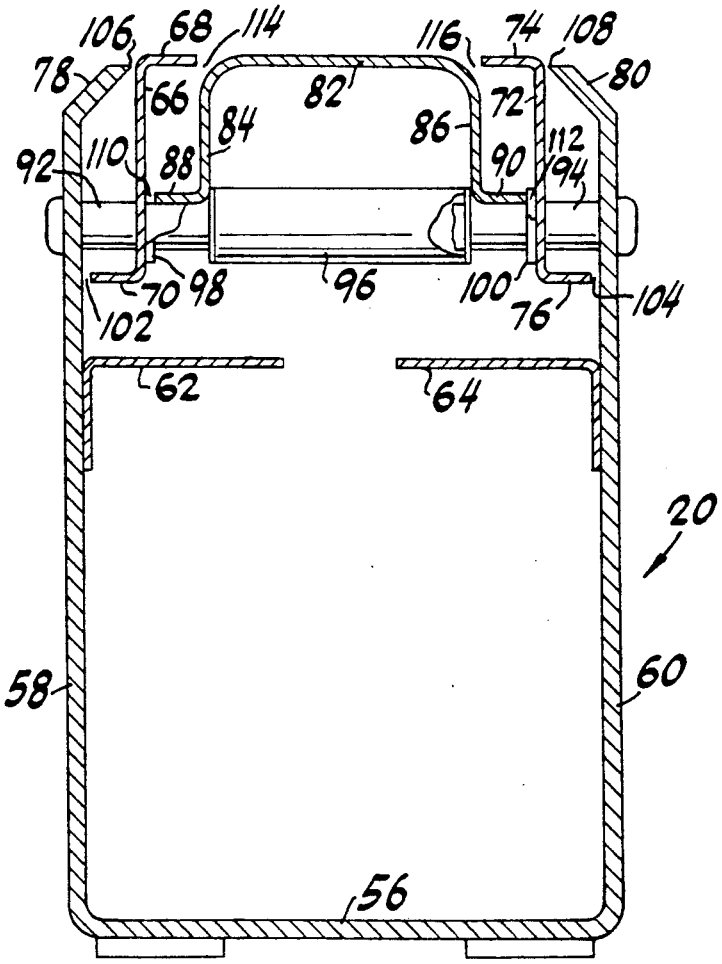
FIG. 4 is a sectional view of our improved flotation dryer nozzle taken along the line 4—4 of FIG. 2 and drawn on an enlarged scale.
Figure 3:
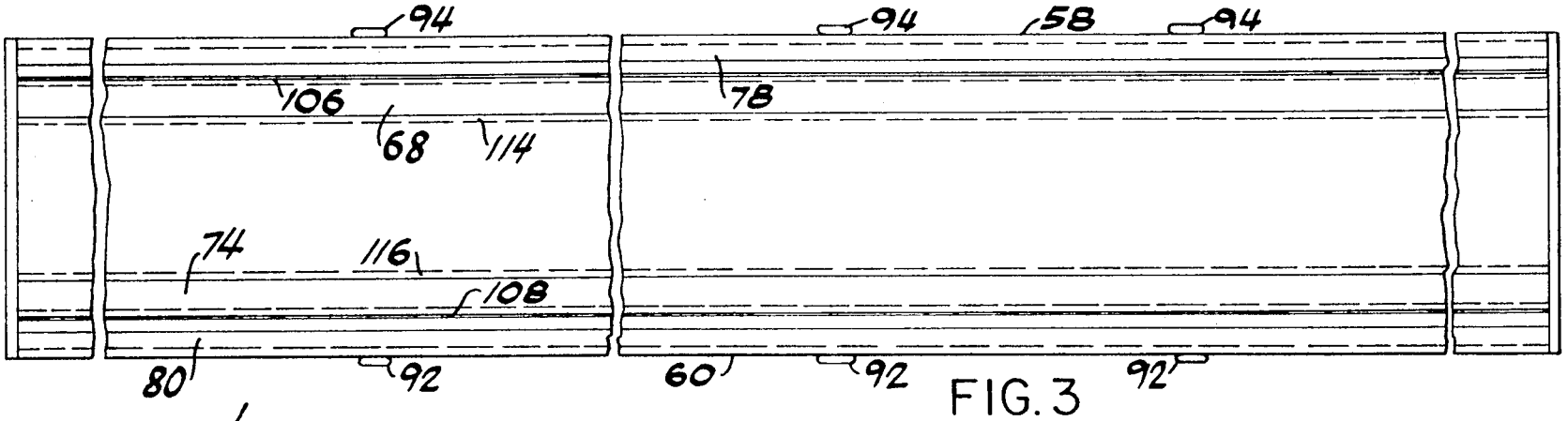
FIG. 3 is a top plan of the form of our improved flotation dryer nozzle shown in FIG. 2.
Figure 2:
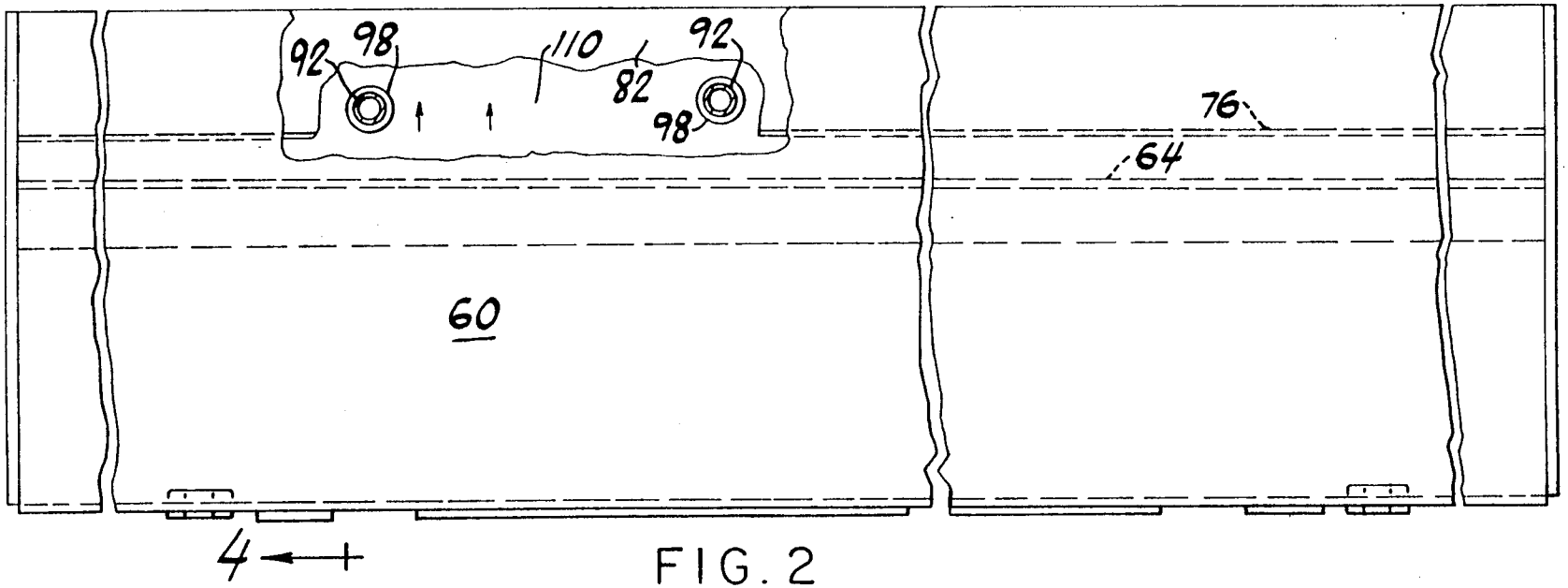
FIG. 2 is a side elevation of our improved flotation dryer nozzle with parts broken away and with other parts shown in section.

Since all of the improved nozzles 20, 22, 24, 34, 36, 38 and 40 are identical, only the nozzle 20 will be described in detail. Referring now to FIGS. 2 to 4, the nozzle 20 includes a base 56 and sides 58 and 60. A pair of internal baffles 62 and 64 secured to the sides 58 and 60 by any suitable means, such for example as by welding or the like, ensure even distribution of the incoming air.

The nozzle 20 includes a first S-shaped member 66 having respective upper and lower horizontal flanges 68 and 70 disposed adjacent to the left wall 58 of the nozzle. A right hand Z-shaped member 72 corresponding to the member 66 is located adjacent to the right wall 60 of the nozzle 20. Member 72 has respective upper and lower horizontal flanges 74 and 76.

Wall 58 has an upper bent-in portion 78 which cooperates with the member 66 in a manner to be described. Similarly, wall 60 has a bent-in portion 80 along the upper edge thereof which cooperates with the member 72.

We position an intermediate member 82 having generally the shape of an omega in cross-section between the members 66 and 68. Member 82 has vertical legs 84 and 86 and respective horizontal flanges 88 and 90 at the lower edges of the legs 84 and 86. Member 82 may be said to have the shape of an inverted U in cross-section with flanges 88 and 90 at the ends of the downwardly directed legs.

The members 66, 72 and 82 just described are held in position within the nozzle by means of rivets 92 and 94 which extend through the sides 58 and 60 and into the interior of a tubular spacer member 96. Washers 98 and 100 space the ends of the flanges 88 and 90 from the respective members 66 and 72.

As can be seen from FIGS. 2 and 3, there are a plurality of pairs of rivets 92 and 94 associated with spacers 96 disposed along the length of the nozzle 20.

As a result of the construction outlined above, the flanges 70 and 76 of the members 66 and 72 form respective air passages 102 and 104 with the sides 58 and 60 of the nozzle 20. Similarly, the members 66 and 72 form respective nozzle openings 106 and 108 with the upper edges of the bent-in portions 78 and 80.

The spaces between the edge of flange 88 and the member 66 between adjacent pairs of washers 98 form air passages 110. Similarly, the spaces between the edge of flange 90 and member 72 between adjacent pairs of washers 100 form air passages 112. We so arrange and form the members 66, 72 and 82 as to provide relatively wide nozzle slots 114 and 116 between member 82 and the inner edges of respective flanges 68 and 74.

It is to be noted that nozzle openings 106 and 108 form a pair of converging type discharge orifices while the nozzle openings 114 and 116 are Coanda type discharge openings. Our combination of these two types of discharge orifices permits the formation of a wider pressure pad area for a given nozzle width without the need for a high velocity discharge and the attendant turbulence. There is a serendipitous relationship between the two types of orifices in that the orifices of the outer convergent type form seals for the air supplied by the inner Coanda type so that the suction effect of the Coanda type orifices reduces the amount of air from the outer pair which would otherwise impinge on the web and be directed away from the desired pressure pad. All of this results in a zone of activity between the nozzle and the web which is more uniform in terms of heat transfer and support than that achieved by nozzles of the prior art.

In operation of our improved flotation dryer nozzle, air supplied to the duct 20, for example, forms a plenum from which air enters the space between wall 58 and member 56 and the space between wall 60 and member 72 through respective openings 102 and 104 at a velocity of, for example, V1. This air emerges from nozzle openings 106 and 108 at substantially the same velocity and is directed inwardly and upwardly or downwardly toward the web 14. Air from the plenum passes through the openings 110 and 112 into the respective spaces between member 66 and leg 84 and member 72 and leg 86 at the same velocity as that of the air emerging from the nozzle openings 106 and 108. However, owing to the relatively large size of openings 114 and 116 compared to openings 110 and 112, a pressure drop occurs across each of the spaces between openings 110 and 114 and openings 112 and 116 so that the air emerging from nozzle openings 114 and 116 is of lower velocity than that which emerges from nozzle openings 106 and 108. Typically, the velocity of the air emerging from the nozzle openings 114 and 116 is approximately 25% of the velocity of the air emerging from nozzle openings 106 and 108. The result is that sufficient air can be discharged from the nozzle at a relatively low velocity to provide a positive pressure path for flotation of the web without the high heat transfer and drying rates associated with the usual flotation nozzle. It is to be noted, moreover, that we achieve this result of providing different discharge velocities from a single source of drying air. That is, we do not require separate blowers to achieve this result.

It is to be noted also that the width of the pressure pad in the direction of movement of the web can be varied to accommodate different flotation and drying requirements. By making the nozzle wider it is possible more uniformly to distribute the heat transfer and to provide more stable flotation for very lightweight webs or films.

It will be seen that we have accomplished the objects of our invention. We have provided an improved flotation dryer nozzle which overcomes the defects of dryer nozzles of the prior art. Our nozzle is especially adapted for use with very lightweight webs or films. It is also especially adapted for use with films or webs carrying heavy adhesive coatings such as require relatively gentle drying to prevent blisters, bubbling and the like. Our nozzle is simple in construction and in operation for the result achieved thereby. We accomplish the result of providing two different nozzle discharge velocities from a single supply source of heating medium, such as air.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. An improved flotation dryer nozzle including in combination an elongated hollow body having a face adapted to be positioned adjacent a web to be dried, means forming respective relatively high velocity convergent discharge orifices adjacent to the longitudinal edges of said face, and means forming respective spaced relatively low velocity Coanda type discharge orifices in said face inboard of said convergent discharge orifices.

2. An improved flotation dryer nozzle including in combination an elongated body having a generally U-shaped cross-section, respective first and second elements, each having a vertical portion and an inwardly extending portion, means mounting said elements adjacent to the legs of said U at the upper ends thereof whereby the upper edges of the legs of said U and said vertical portions form relatively narrow nozzle openings, a third element having a generally U-shaped cross-section with outwardly extending flanges at the ends of the legs of the U, and means mounting said third element in said body with the base of the third element adjacent to the ends of said inwardly extending portions to form a pair of relatively wider nozzle openings and with said flanges relatively closely spaced from said vertical portions whereby the spaces between the flanges and legs of the third element and the respective first and second elements provide pressure reduction regions.

3. A nozzle as in claim 2 in which the upper edges of the legs of said body are bent inwardly toward said vertical portions.

4. A flotation dryer nozzle assembly for producing a pad of drying gas impinging on a moving web adjacent to the assembly, said pad having leading and trailing edges with reference to the direction of movement of the web including in combination means forming respective first and second plenum regions within and extending along the length of said body, means for supplying drying gas from a common source to both of said regions to form first and second plenums, means forming respective first and second relatively narrow nozzle slits opening from and extending along the length of said first plenum region adjacent to the leading and trailing edges of said pad to produce relatively high velocity discharges of gas at said leading and trailing edges, and means forming third and fourth relatively wider nozzle slits opening from and extending along the length of said second plenum region adjacent to and inboard of said leading and trailing edges for producing relatively lower velocity discharges of gas.

5. An assembly as in claim 4 in which said supplying means supplies gas to said first and second regions at the same velocity.

6. An assembly as in claim 4 in which the aggregate area of said third and fourth nozzle openings is sufficiently greater than the area of the means for conducting gas to said second plenum region as to produce a pressure drop across said second plenum.

7. An assembly as in claim 4 in which said relatively narrow slits form convergent type nozzle orifices and in which said relatively wider slits form Coanda type nozzle orifices.

* * * * *